US006732616B2

(12) United States Patent
Lin

(10) Patent No.: US 6,732,616 B2
(45) Date of Patent: May 11, 2004

(54) WRENCH LOCKING AND POSITIONING DEVICE

(75) Inventor: Chorng-Jiang Lin, Taichung (TW)

(73) Assignee: Cheng-Tsai Chang, Taichung (TW)

( * ) Notice: Subject to any disclaimer, the term of this patent is extended or adjusted under 35 U.S.C. 154(b) by 121 days.

(21) Appl. No.: 10/086,437

(22) Filed: Mar. 4, 2002

(65) Prior Publication Data

US 2003/0164072 A1 Sep. 4, 2003

(51) Int. Cl.[7] ..... B25B 13/58

(52) U.S. Cl. ..... 81/180.1; 81/179; 81/60; 81/119; 81/124.3

(58) Field of Search ..... 87/60–63.2, 119, 87/124.3, 179, 180.1

(56) References Cited

U.S. PATENT DOCUMENTS 584,591 A * 6/1897 Johnson ..... 81/180.1
1,134,499 A * 4/1915 Aube ..... 81/179
1,350,315 A * 8/1920 Katzmarek ..... 81/60
1,550,436 A * 8/1925 Hall ..... 81/119
2,751,802 A * 6/1956 Reuillard ..... 81/124.3
3,165,015 A * 1/1965 Hinrichs ..... 81/179
3,745,859 A * 7/1973 Evans et al. ..... 81/119
5,287,777 A * 2/1994 Kolodziej ..... 81/179
5,832,795 A * 11/1998 Reynolds ..... 81/180.1
5,946,989 A * 9/1999 Hsieh ..... 81/180.1
6,089,127 A * 7/2000 Dominguez ..... 81/119
6,186,032 B1 * 2/2001 Raines ..... 81/119

* cited by examiner

*Primary Examiner*—James G. Smith
(74) *Attorney, Agent, or Firm*—Rosenberg, Klein & Lee

(57) ABSTRACT

A wrench locking and positioning device includes at least one positioning body formed with an oblique slide guide portion facing an end face of a drive portion of a drive head of a wrench, and an elastic member mounted in the positioning body, for normally pushing the oblique slide guide portion of the positioning body to extend into the drive portion of the drive head of the wrench.

8 Claims, 12 Drawing Sheets

WRENCH LOCKING AND POSITIONING DEVICE

BACKGROUND OF THE INVENTION

1. Field of the Invention

The present invention relates to a wrench locking and positioning device, and more particularly to a wrench locking and positioning device including a positioning body that may provide a retaining and positioning effect on the workpiece, thereby facilitating the drive portion of the drive head of the wrench rotating the workpiece.

2. Description of the Related Art

A first conventional wrench in accordance with the prior comprises a drive head having a drive portion for rotating a workpiece such as a bolt, a nut or the like. The drive portion of the drive head of the wrench is formed an opening for receiving the workpiece, and the opening is usually defined through the drive portion of the drive head of the wrench. Thus, the workpiece is easily detached from the opening of the drive portion of the drive head of the wrench, thereby causing inconvenience to the user.

A second conventional wrench in accordance with the prior comprises a C-shaped snap mounted in the drive portion of the drive head of the wrench for retaining the workpiece. However, the C-shaped snap largely decreases the structural strength of the drive portion of the drive head of the wrench, so that the drive portion of the drive head of the wrench is easily broken due to the larger force.

SUMMARY OF THE INVENTION

The present invention has arisen to mitigate and/or obviate the disadvantage of the conventional wrench.

The primary objective of the present invention is to provide a wrench locking and positioning device including a positioning body that may provide a retaining and positioning effect on the workpiece, thereby facilitating the drive portion of the drive head of the wrench rotating the workpiece.

Another objective of the present invention is to provide a wrench locking and positioning device, wherein the drive head of the wrench may operate the workpiece rigidly and stably by the positioning body, thereby facilitating the drive head of the wrench rotating the workpiece.

A further objective of the present invention is to provide a wrench locking and positioning device, wherein the locking body of the drive head of the wrench may be locked in the locking groove of the positioning body during movement of the positioning body, thereby providing a temporary positioning effect on the positioning body.

A further objective of the present invention is to provide a wrench locking and positioning device, wherein the oblique slide guide portion of the positioning body has a flat portion that may be rested on the workpiece rigidly and exactly, thereby facilitating the drive head of the wrench rotating the workpiece.

In accordance with the present invention, there is provided a wrench locking and positioning device, comprising:

at least one positioning body formed with an oblique slide guide portion facing an end face of a drive portion of a drive head of a wrench; and an elastic member mounted in the positioning body, for normally pushing the oblique slide guide portion of the positioning body to extend into the drive portion of the drive head of the wrench.

Further benefits and advantages of the present invention will become apparent after a careful reading of the detailed description with appropriate reference to the accompanying drawings.

DETAILED DESCRIPTION OF THE INVENTION

Figure 1:
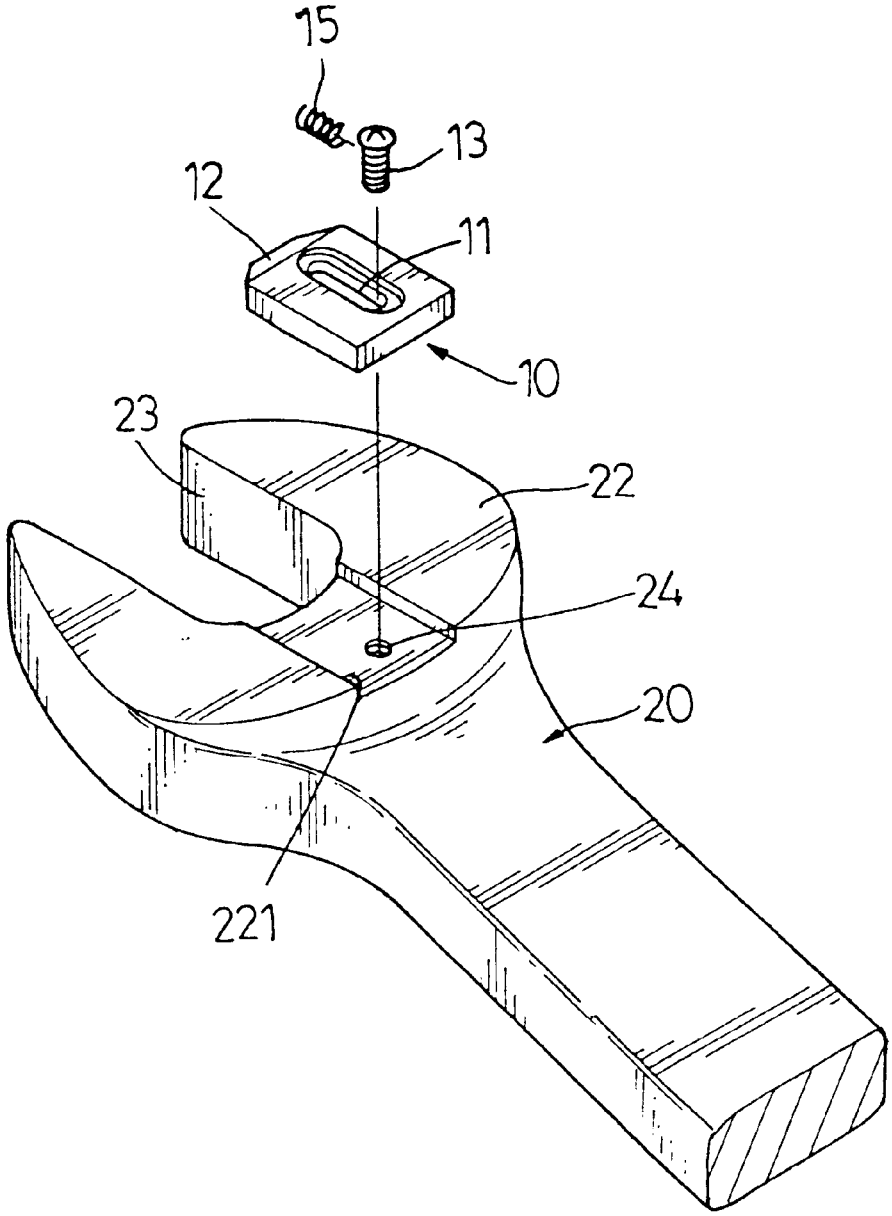
FIG. 1 is an exploded perspective view of a wrench locking and positioning device in accordance with a first embodiment of the present invention.
Figure 2:
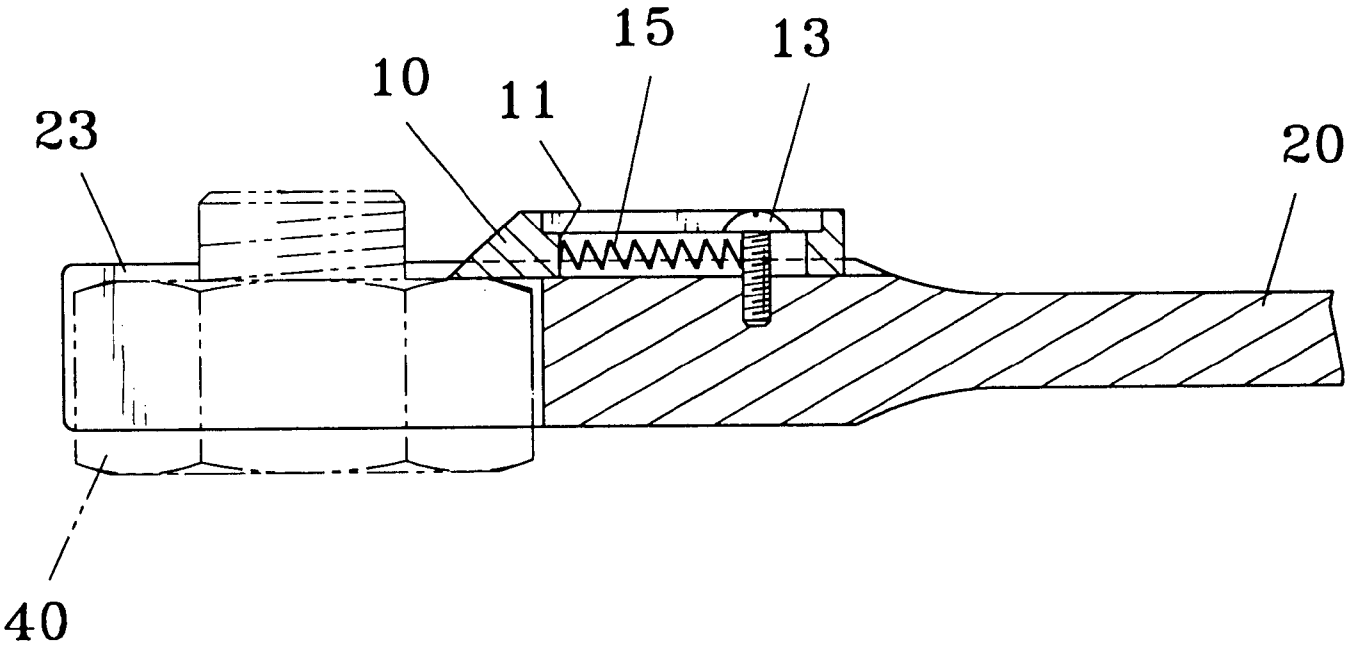
FIG. 2 is a side plan cross-sectional assembly view of the wrench locking and positioning device as shown in FIG. 1.

Referring to the drawings and initially to FIGS. 1 and 2, a wrench locking and positioning device in accordance with a first embodiment of the present invention comprises a plate-shaped positioning body 10 formed with an elongated retaining slot 11. The positioning body 10 has an end portion provided with an oblique slide guide portion 12.

A retaining member 13, such as a screw, is extended through the retaining slot 11 of the positioning body 10, and is screwed into an end face of the wrench 20.

An elastic member 15 is mounted in the retaining slot 11 of the positioning body 10, and is biased between the retaining member 13 and a wall of the retaining slot 11 of the positioning body 10, thereby providing an elastic restoring force to the positioning body 10. Preferably, the elastic member 15 is a compression spring.

The wrench 20 has a drive head 22 provided with an opened drive portion 23. The drive head 22 of the wrench 20 is formed with a locking bore 24 into which the retaining member 13 is screwed, so that the retaining member 13 may be used to limit the sliding stroke of the positioning body 10.

Thus, the positioning body 10 is pushed by the elastic member 15 toward the drive portion 23 of the drive head 22 of the wrench 20, so that the oblique slide guide portion 12 of the positioning body 10 may be moved to extend into the space of the drive portion 23 of the drive head 22 of the wrench 20 as shown in FIG. 2, and may be rested on a workpiece, such as a bolt, a nut or the like, received in the space of the drive portion 23 of the drive head 22 of the wrench 20, so as to provide a retaining and positioning effect on the workpiece, thereby facilitating the drive portion 23 of the drive head 22 of the wrench 20 rotating the workpiece.

Figure 3:
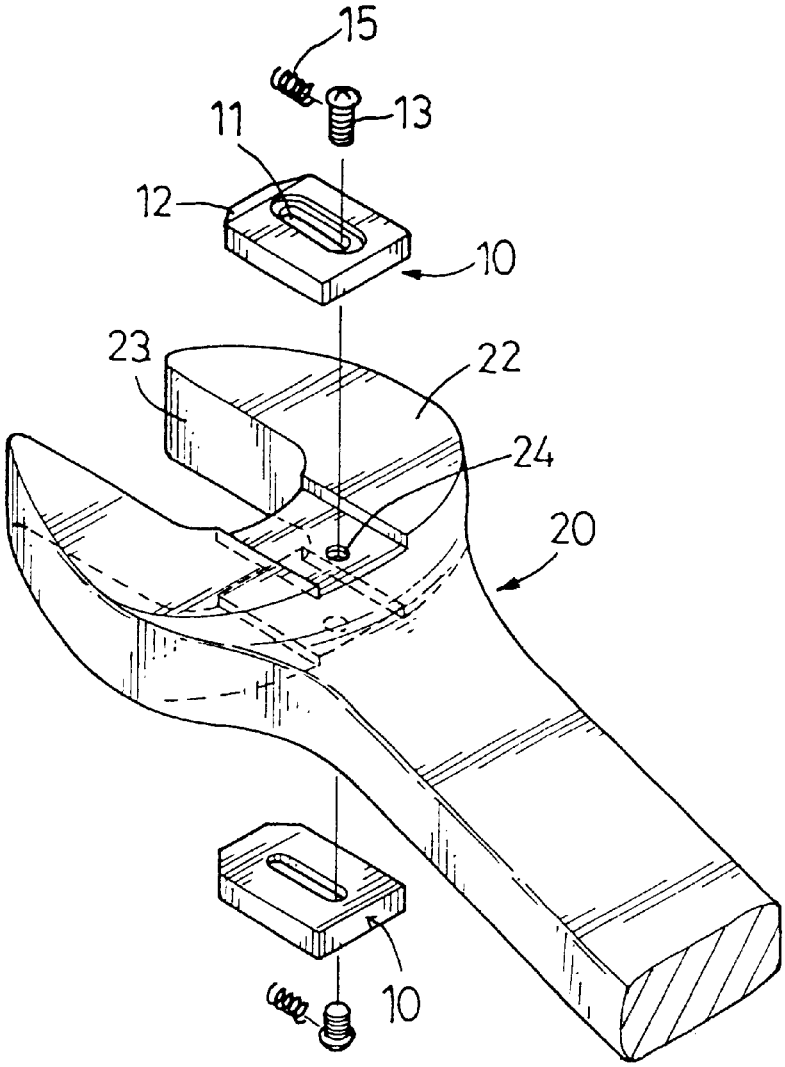
FIG. 3 is an exploded perspective view of a wrench locking and positioning device in accordance with a second embodiment of the present invention.
Figure 3A:
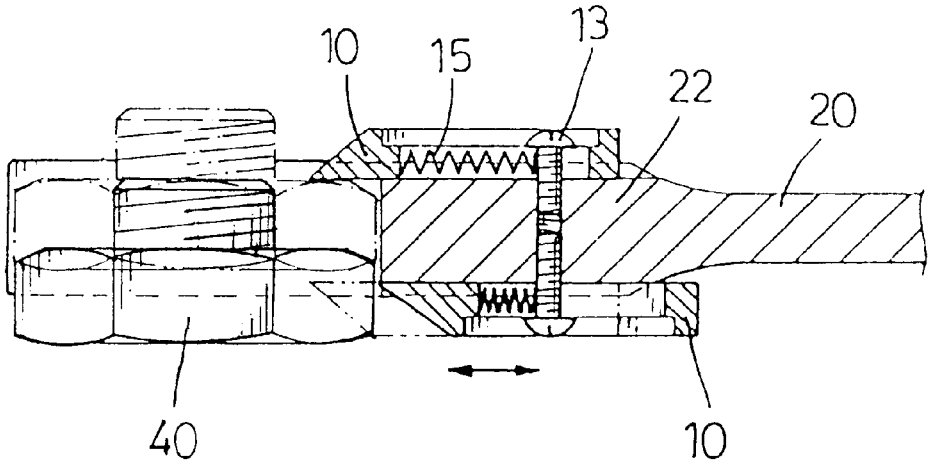
FIG. 3*a* is a side plan cross-sectional assembly view of the wrench locking and positioning device as shown in FIG. 3.
Figure 4:
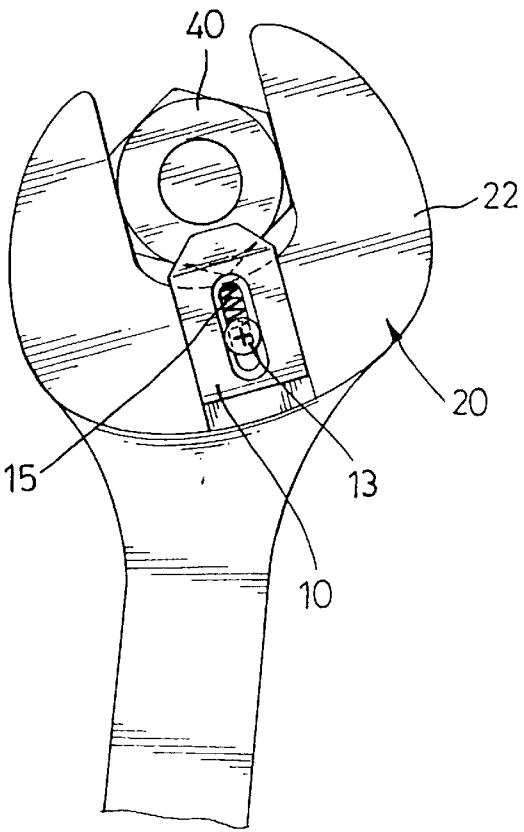
FIG. 4 is a plan assembly view of the wrench locking and positioning device as shown in FIG. 3.

Referring to FIGS. 3 and 4, a wrench locking and positioning device in accordance with a second embodiment of the present invention comprises two positioning bodies 10 respectively mounted on the top side and the bottom side of the drive head 22 of the wrench 20.

Figure 5:
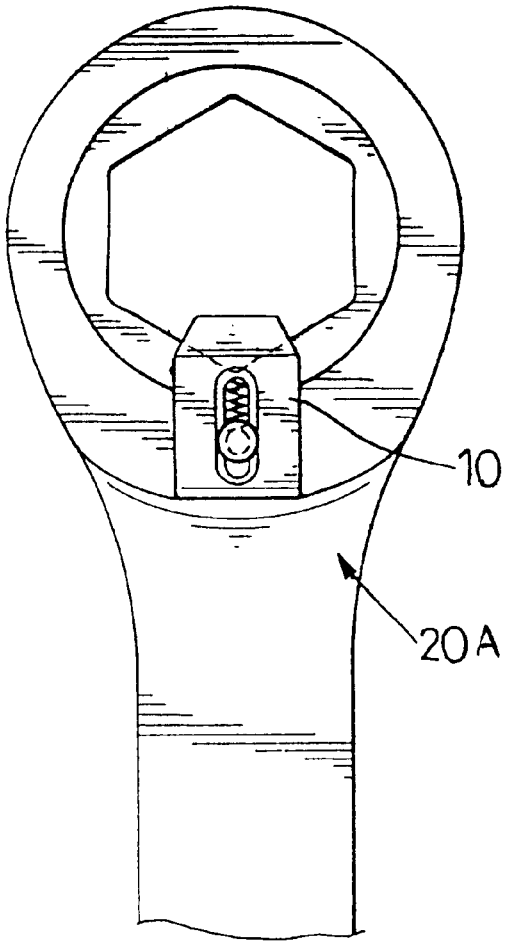
FIG. 5 is a plan assembly view of the wrench locking and positioning device which may be used to a closed-ended wrench.
Figure 6A:
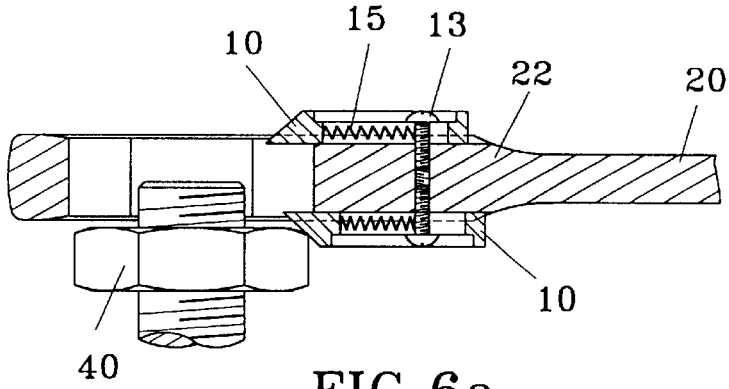
FIG. 6*a* is an operational view of the wrench locking and positioning device as shown in FIG. 5.
Figure 6B:
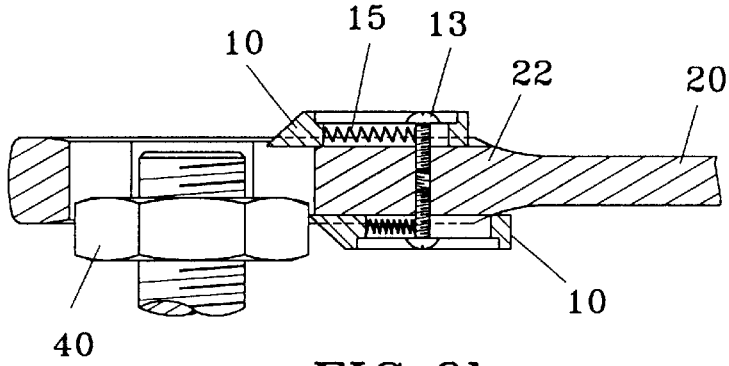
FIG. 6*b* is an operational view of the wrench locking and positioning device as shown in FIG. 6*a;*
Figure 6C:
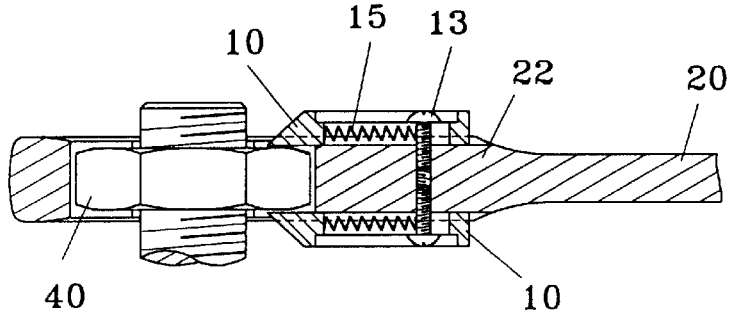
FIG. 6*c* is an operational view of the wrench locking and positioning device as shown in FIG. 6*b;*

Referring to FIG. 5, the positioning body 10 of the wrench locking and positioning device in accordance with the present invention may be used to a closed-ended wrench 20A.

As shown in FIGS. 3*a*, 6*a*, 6*b* and 6*c*, the oblique slide guide portion 12 of the lower positioning body 10 may be pressed by the workpiece 40 to move toward the drive head 22 of the wrench 20, so as to retract the lower positioning body 10. Then, the workpiece 40 may be received in the space of the drive portion 23 of the drive head 22 of the wrench 20, and may be retained and positioned by the upper positioning body 10 and the lower positioning body 10, so that the drive portion 23 of the drive head 22 of the wrench 20 may operate the workpiece 40 rigidly and stably, thereby facilitating the drive portion 23 of the drive head 22 of the wrench 20 rotating the workpiece 40.

Figure 7:
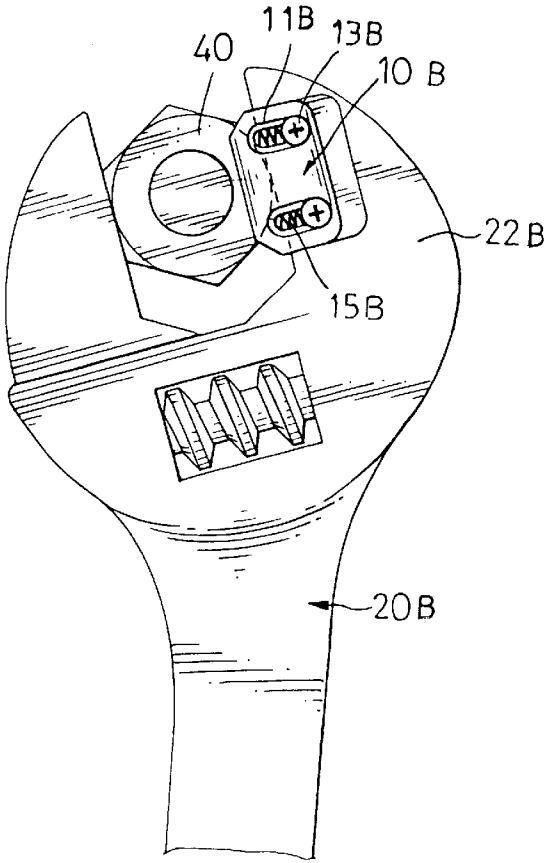
FIG. 7 is a plan assembly view of a wrench locking and positioning device in accordance with a third embodiment of the present invention.

Referring to FIG. 7, a wrench locking and positioning device in accordance with a third embodiment of the present invention is used to the drive head 22B of a movable wrench 20B, and comprises a positioning body 10B formed with two elongated retaining slots 11B for receiving two retaining members 13B and two elastic members 15B.

Thus, the drive head 22B of the wrench 20B may operate the workpiece 40 rigidly and stably, thereby facilitating the drive head 22B of the wrench 20B rotating the workpiece 40.

Referring to FIGS. 1–7, the drive head 22 of the wrench 20 is formed with an elongated retaining groove 221, for limiting the sliding direction and position of the positioning body 10, thereby increasing the stability of movement of the positioning body 10.

Figure 8:
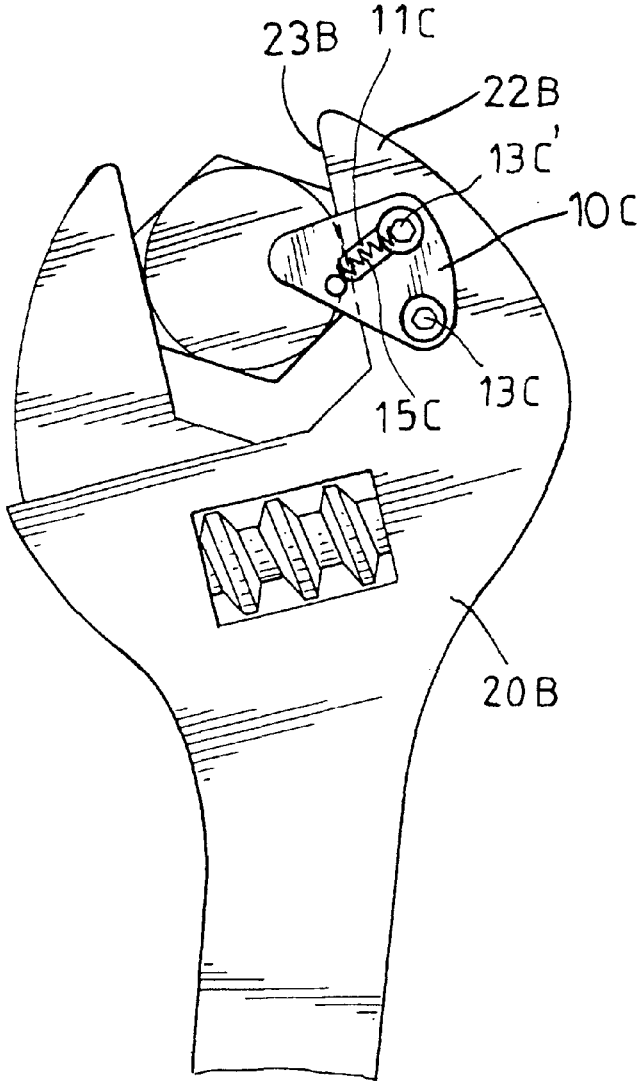
FIG. 8 is a plan assembly view of a wrench locking and positioning device in accordance with a fourth embodiment of the present invention.

Referring to FIG. 8, a wrench locking and positioning device in accordance with a fourth embodiment of the present invention is used to the drive head 22B of a movable wrench 20B, and comprises a positioning body 10C formed with an arcuate retaining slot 11C. A first retaining member 13C is threaded into the drive head 22 of the wrench 20, so that the positioning body 10C may be pivoted about the first retaining member 13C. A second retaining member 13C' is received in the arcuate retaining slot 11C of the positioning body 10C, so that the second retaining member 13C' may be used to limit the sliding stroke of the positioning body 10C.

Figure 9:
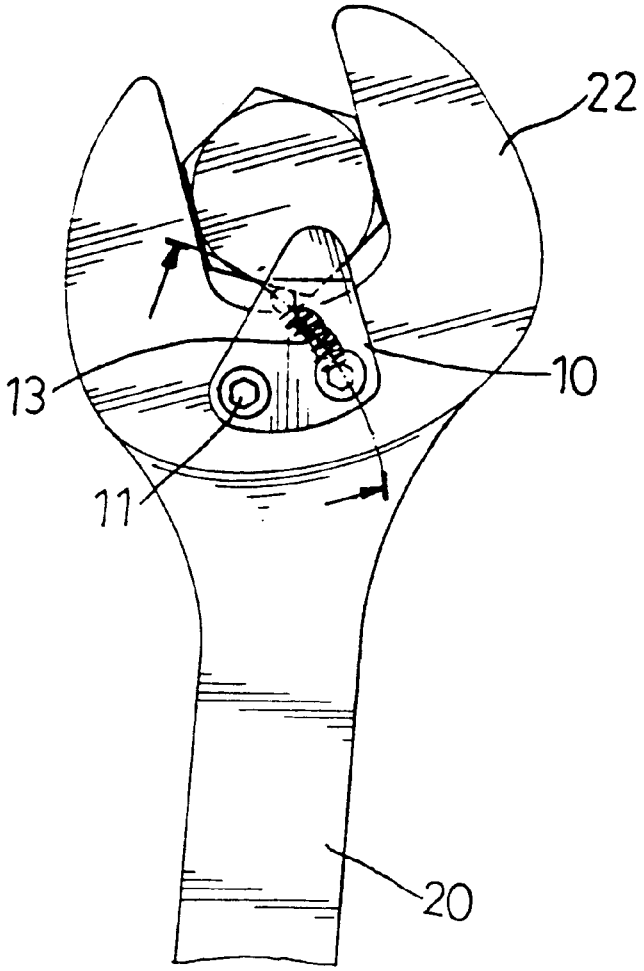
FIG. 9 is a plan assembly view of a wrench locking and positioning device which may be used to a fixed wrench.

Referring to FIG. 9, the wrench locking and positioning device in accordance with a fourth embodiment of the present invention may be used to the drive head 22 of a fixed wrench 20.

Figure 10:
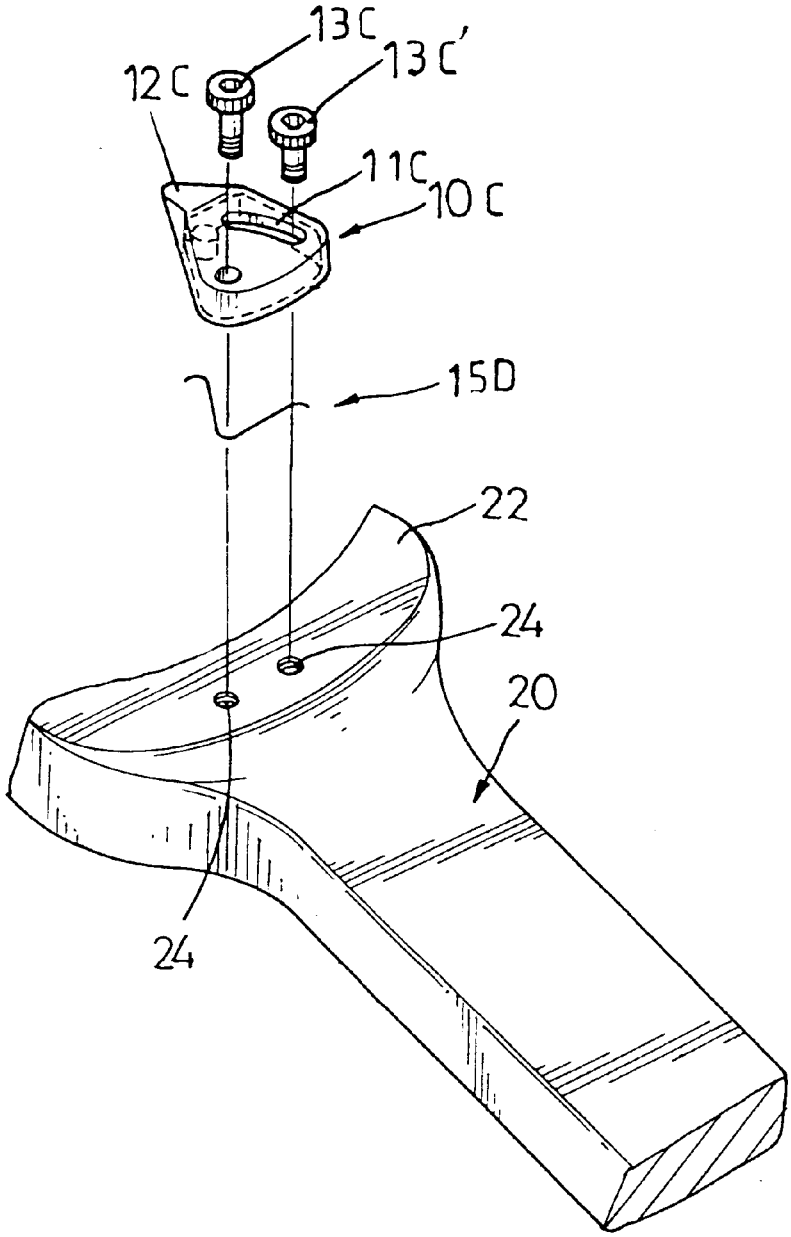
FIG. 10 is an exploded perspective view of a wrench locking and positioning device in accordance with a fifth embodiment of the present invention.

Referring to FIG. 10, a wrench locking and positioning device in accordance with a fifth embodiment of the present invention is used to the drive head 22 of a fixed wrench 20, wherein the elastic member 15D is a V-shaped elastic wire.

Figure 11:
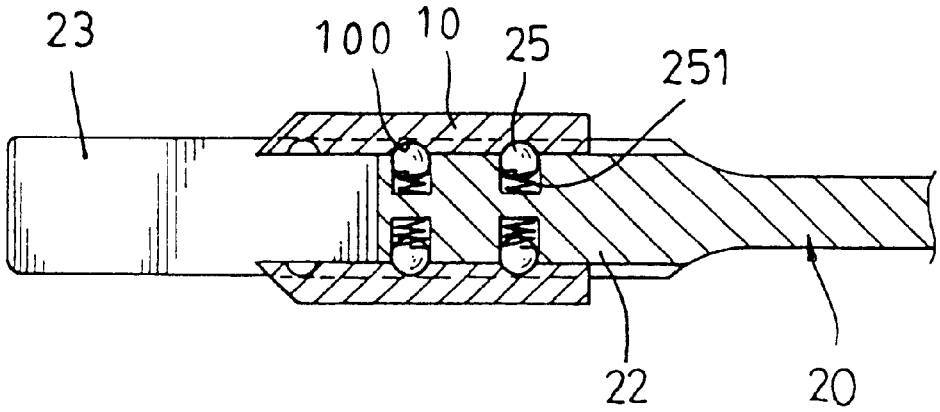
FIG. 11 is a side plan cross-sectional assembly view of a wrench locking and positioning device in accordance with a sixth embodiment of the present invention.
Figure 12:
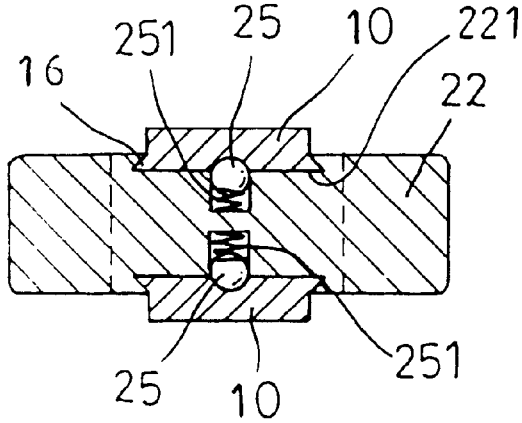
FIG. 12 is a front plan cross-sectional assembly view of a wrench locking and positioning device in accordance with a sixth embodiment of the present invention.

Referring to FIGS. 11 and 12, a wrench locking and positioning device in accordance with a sixth embodiment of the present invention is shown. The positioning body 10 is formed with at least one locking groove 100, and the drive head 22 of the wrench 20 is provided with at least one locking body 25, such as a ball, and at least one elastic member 251.

Thus, the locking body 25 may be locked in the locking groove 100 during movement of the positioning body 10, thereby providing a temporary positioning effect on the positioning body 10.

As shown in FIG. 12, the retaining groove 221 of the drive head 22 of the wrench 20 has a dovetail shape, and the positioning body 10 is provided with a dovetail-shaped portion 16 received in the dovetail-shaped retaining groove 221, thereby preventing the positioning body 10 from detaching from the drive head 22 of the wrench 20.

Figure 13:
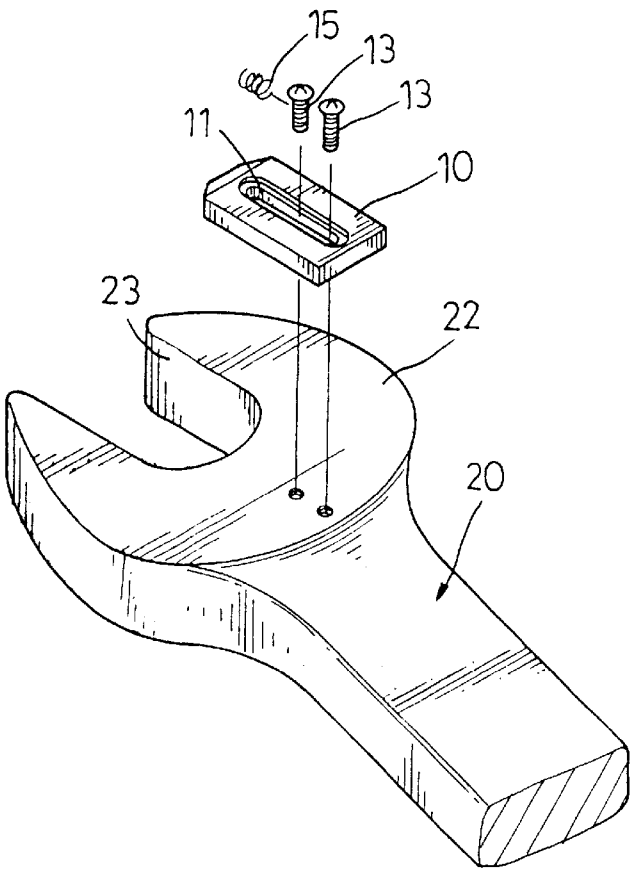
FIG. 13 is an exploded perspective view of a wrench locking and positioning device in accordance with a seventh embodiment of the present invention.

Referring to FIG. 13, a wrench locking and positioning device in accordance with a seventh embodiment of the present invention comprises two retaining members 13 respectively received in the retaining slot 11 of the positioning body 10.

Accordingly, the wrench locking and positioning device in accordance with the present invention has the following advantages.

1. The positioning body may provide a retaining and positioning effect on the workpiece, thereby facilitating the drive portion of the drive head of the wrench rotating the workpiece.

2. The drive head of the wrench may operate the workpiece rigidly and stably by the positioning body, thereby facilitating the drive head of the wrench rotating the workpiece.

3. The locking body of the drive head of the wrench may be locked in the locking groove of the positioning body during movement of the positioning body, thereby providing a temporary positioning effect on the positioning body.

4. The oblique slide guide portion of the positioning body has a flat portion that may be rested on the workpiece rigidly and exactly, thereby facilitating the drive head of the wrench rotating the workpiece.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench, comprising:

a drive head having a drive portion;

a locking and positioning device including:

at least one positioning body movably mounted on the drive head and having an end portion formed with an oblique slide guide portion facing an end face of the drive portion of the drive head;

the at least one positioning body being formed with at least one retaining slot;

at least one retaining member extended through the at least one retaining slot of the at least one positioning body and screwed into an end face of the drive head; and at least one elastic member mounted in the at least one retaining slot of the at least one positioning body and biased between the retaining member and a wall of the at least one retaining slot of the at least one positioning body, for normally pushing the oblique slide guide portion of the at least one positioning body to extend into the drive portion of the drive head.

2. The wrench in accordance with claim 1, wherein the drive head is formed with at least one locking bore into which the at least one retaining member is screwed.

3. The wrench in accordance with claim 1, wherein the locking and positioning device comprises two positioning bodies respectively mounted on a top side and a bottom side of the drive head.

4. The wrench in accordance with claim 1, wherein the at least one positioning body is formed with two retaining slots for receiving two retaining members and two elastic members.

5. The wrench in accordance with claim 1, wherein the drive head is formed with at least one retaining groove, for limiting the at least one positioning body.

6. The wrench in accordance with claim 5, wherein the at least one retaining groove of the drive head has a dovetail shape, and the at least one positioning body is provided with a dovetail-shaped portion received in the dovetail-shaped retaining groove.

7. The wrench in accordance with claim 1, wherein the elastic member is a compression spring.

8. The wrench in accordance with claim 1, wherein the locking and positioning device comprises two retaining members respectively received in the at least one retaining slot of the at least one positioning body.

* * * * *

UNITED STATES PATENT AND TRADEMARK OFFICE

CERTIFICATE OF CORRECTION

PATENT NO. : 6,732,616 B2
DATED : May 11, 2004
INVENTOR(S) : Chorng-Jiang Lin

It is certified that error appears in the above-identified patent and that said Letters Patent is hereby corrected as shown below:

Title page,
Item [73], delete the name "Cheng-Tsai Chang" and insert therefore -- Chen-Tsai Chang --.

Signed and Sealed this

Sixth Day of July, 2004

JON W. DUDAS
*Acting Director of the United States Patent and Trademark Office*